US011548050B2

(12) United States Patent
Luetkemeyer et al.

(10) Patent No.: US 11,548,050 B2
(45) Date of Patent: Jan. 10, 2023

(54) RESILIENTLY MOUNTED, SEGMENTED HOT FORMING TOOL AND METHOD FOR PRODUCING A HOT FORMED AND PRESS-HARDENED STEEL COMPONENT HAVING A SHARPLY DEFINED TRANSITION REGION

(71) Applicant: BENTELER Automobiltechnik GmbH, Paderborn (DE)

(72) Inventors: Oliver Luetkemeyer, Paderborn (DE); Matthias Wiemers, Paderborn (DE); Robert Stockter, Hannover (DE)

(73) Assignee: BENTELER AUTOMOBILTECHNIK GMBH, Paderborn (DE)

( * ) Notice: Subject to any disclaimer, the term of this patent is extended or adjusted under 35 U.S.C. 154(b) by 575 days.

(21) Appl. No.: 16/275,873

(22) Filed: Feb. 14, 2019

(65) Prior Publication Data

US 2019/0176203 A1 Jun. 13, 2019

Related U.S. Application Data

(63) Continuation of application No. 14/978,753, filed on Dec. 22, 2015, now Pat. No. 10,245,632.

(30) Foreign Application Priority Data

Dec. 23, 2014 (DE) ..... 102014119545.0

(51) Int. Cl.
*B21D 22/02* (2006.01)
*B21D 22/20* (2006.01)
(Continued)

(52) U.S. Cl.
CPC ..... *B21D 22/022* (2013.01); *B21D 22/208* (2013.01); *B21D 37/16* (2013.01);
(Continued)

(58) Field of Classification Search
CPC .... B21D 22/022; B21D 22/02; B21D 22/208; B21D 37/01; B21D 37/16; B21D 53/88
See application file for complete search history.

(56) References Cited

U.S. PATENT DOCUMENTS

2004/0112485 A1 6/2004 Reinhold
2006/0191310 A1* 8/2006 Turnbull ..... B21D 51/26 72/348
(Continued)

FOREIGN PATENT DOCUMENTS

CN 102304612 1/2012
CN 102554048 7/2012
(Continued)

OTHER PUBLICATIONS

Machine Translation of Doerr EP 2548670A1 (Year: 2013).*

*Primary Examiner* — Debra M Sullivan
(74) *Attorney, Agent, or Firm* — Jacobson Holman PLLC

(57) ABSTRACT

A hot forming tool includes a top tool and a bottom tool, both of which can be moved towards each other. When the hot forming tool is closed, a mold cavity is formed between the top tool and the bottom tool, with the top tool and/or the bottom tool being divided into at least two segments. The hot forming tool has one segment designed as a heating segment. The heating segment includes a compensating element on a side thereof opposite the mold cavity, to compensate for a thermal expansion of the heating segment in the press stroke direction.

18 Claims, 3 Drawing Sheets

(51) Int. Cl.

| | |
|---|---|
| ***B21D 37/16*** | (2006.01) |
| ***B21D 53/88*** | (2006.01) |
| ***B30B 15/06*** | (2006.01) |
| ***B30B 15/00*** | (2006.01) |

(52) U.S. Cl.
CPC ..... *B21D 53/88* (2013.01); *B30B 15/007* (2013.01); *B30B 15/064* (2013.01); *B30B 15/067* (2013.01)

(56) References Cited

U.S. PATENT DOCUMENTS

| | | | | |
|---|---|---|---|---|
| 2011/0219841 | A1 | 9/2011 | Domange et al. | |
| 2013/0205863 | A1* | 8/2013 | Loesch ..... | C21D 9/0062 72/342.7 |
| 2014/0260493 | A1 | 9/2014 | Yoon | |

FOREIGN PATENT DOCUMENTS

| | | |
|---|---|---|
| CN | 104043732 | 9/2014 |
| DE | 10256621 | 4/2004 |
| DE | 6012997 | 5/2008 |
| DE | 102009043926 | 3/2011 |
| DE | 102010027554 | 1/2012 |
| DE | 102011018850 | 10/2012 |
| DE | 102011102167 | 11/2012 |
| DE | 102012112334 | 6/2014 |
| EP | 2143808 | 1/2010 |
| EP | 2548670 | 1/2013 |
| WO | WO 01/96089 | 12/2001 |

* cited by examiner

RESILIENTLY MOUNTED, SEGMENTED HOT FORMING TOOL AND METHOD FOR PRODUCING A HOT FORMED AND PRESS-HARDENED STEEL COMPONENT HAVING A SHARPLY DEFINED TRANSITION REGION

BACKGROUND OF THE INVENTION

1. Field of the Invention

The present invention relates to a hot forming tool having a top tool and a bottom tool, and a mold cavity provided therebetween.

Furthermore, the present invention relates to a method of producing a hot formed and press-hardened steel component, with strength properties that are partially different from each other.

2. Description of Related Art

In the state of the art it is known to use hot forming and press hardening technology to produce formed sheet metal components. In particular, such a method is used to produce motor vehicle components and in this case, in particular, preferably motor vehicle safety components as well as motor vehicle structural components.

First, a blank made of a hardenable steel alloy is provided; and this blank is heated at least partially to above austenitizing temperature. In the hot state the at least partially austenitized sheet metal blank has a higher degree of forming freedom, so that it is formed into the sheet metal component in a press forming tool. It is even more highly preferred that the press forming tool be cooled as early as during or upon completion of the forming process in such a way that the hot formed sheet metal component that may still be found in the hot forming tool is then hardened. In particular, the sheet metal component that is produced is cooled so rapidly that the austenitic microstructure is transformed into a substantially martensitic microstructure or into a mixed microstructure. As an alternative, it is also possible to move the formed sheet metal component that is still hot into a separate holding tool and to quench-harden said formed sheet metal component in this holding tool by means of rapid quenching.

In particular, when partially hardening a component, it is necessary to produce a sharply defined transition region between the hardened regions and the unhardened regions. However, owing to the thermal conduction inside the blank and also the thermal conduction inside the press-forming tool, it has proven to be especially advantageous to design the press forming tool so as to be segmented. This means that, for example, the upper tool and/or the lower tool is/are divided into at least two different segments and that between the segments there is a physical separation, in particular, in the form of an air gap. The effect is a suppression of the thermal conduction inside the tool. However, the drawback is that the separate segments expand at different rates due to the different temperatures.

For example, a tool of this type is known from the patent DE 10 2011 018 850 A1.

Furthermore, during the production of hot formed and press-hardened components having strength regions that are partially different from each other, the transition zone from the hard to the ductile region is not adequately clearly defined due to the thermal conduction in the blank to be formed or more specifically in the formed component.

SUMMARY OF THE INVENTION

The object of the present invention is to improve, based on the prior art, a segmented hot formed tool in such a way that the expansion owing to the different temperatures generated in the segments of the top tool and/or the bottom tool can be compensated for and that adequate abutting contact between the mold surfaces of the top tool and the bottom tool and the sheet metal blank to be formed or more specifically the formed sheet metal component is produced. Furthermore, the object of the present invention is to provide a method for sharply defining a transition region in a hot formed and press-hardened component comprising strength regions that are different from each other.

The invention achieves the aforementioned object with a hot forming tool, according to the features described herein.

Furthermore, the invention achieves the process engineering part of the aforementioned object with a method for producing hot formed and press-hardened components described herein.

Advantageous design variants of the inventive hot forming tool are also described herein.

The hot forming tool comprises a top tool and a bottom tool, both of which can be moved towards each other. When the hot forming tool is closed, a mold cavity is formed between the top tool and the bottom tool; and the top tool and/or the bottom tool is/are divided into at least two segments. The formed sheet metal component that is produced is in abutting contact with the respective mold surface of the top tool or the bottom tool in the mold cavity.

The hot forming tool is characterized according to the invention in that at least one segment is designed as a heating segment; and that the heating segment comprises a compensating element on a side opposite the mold cavity, so that it is possible to compensate for a thermal expansion of the heating segment in the direction of the press stroke.

Thus, within the scope of the present invention the hot forming tool is used, in particular, to form sheet metal blanks, where the sheet metal blanks exhibit a higher temperature than room temperature. In this case the sheet metal blanks may be made of a steel alloy, but may also be made of a light-weight metal alloy, for example, an aluminum alloy. Preferably, however, a hot formable and hardenable steel alloy is processed with the inventive hot forming tool, so that the hot forming tool is designed, in particular, as a hot forming and press-hardening tool. Then the temperature of the component to be hot formed exhibits at least partially a temperature above the austenitizing temperature, thus, above AC3.

Preferably the compensating element in connection with a floating mount is designed with one degree of linear freedom, in particular, in the press stroke direction, in connection with a spring. The heating segment itself is heated preferably actively, so that, for example, a heat source is integrated, in particular, in the heating segment itself.

Preferably a heating segment is provided in the top tool; and a heating segment, which is arranged to correspond to said former heating segment, is provided in the bottom tool. However, it is possible to provide a heating segment in just the top tool alone or to provide a heating segment in just the bottom tool. It is also possible to provide several heating segments in the top tool and the bottom tool.

Then the remaining segments, in particular the segments adjacent to the heating segment, may be provided with cooling channels and are temperature controlled, so that the formed sheet metal blank is cooled so rapidly that if, for example, the blank exhibits an austenitic microstructure, the result is a hardened microstructure, in particular, a martensitic microstructure. Consequently the heating segment has a higher temperature during the stratified operation than the rest of the segments of the hot forming tool and expands more. Even the temperature and the dimensions of the heating segment before and during contact with the blank are different from each other. The compensating element on the rear side of the heating segment makes it possible to compensate for a thermal expansion, in the press stroke direction in the heating segment in the top tool or in the bottom tool, thus a thermal expansion in the direction of the mold cavity, with the compensating element. For this purpose the heating segment is mounted, in particular, resiliently, so that an expansion of the heating segment results in the compensating element being compressed; and a contraction of the heating segment leads to an expansion of the compensating element. As a result, the absolute position of the mold surface of the heating segment in the mold cavity is approximately constant, so that the blank is brought into uniform abutting contact with the mold surface of the heating segment and the mold surface of the adjacent segments.

As a result, it is possible to achieve a sharply defined transition region between the selectively adjusted microstructural states in the individual sections of the components produced and with different degrees of hardness.

Various heat sources can be used as the heat source in the heating segment. For example, conceivable are heating cartridges or also resistance heating in the form of heating wires. Also conceivable is an inductive heat source, which can then be integrated in the heating segment or which is also disposed externally, in relation to the mold cavity, behind the heating segment.

Furthermore, it is particularly preferred that the heating segment be designed undersized at room temperature. This means that the actual size of the heating segment in the state at room temperature is smaller than the desired size of the heating segment at the operating temperature. The size data relate to the absolute position of the mold surface of the heating segment in the mold cavity. When the heating segment becomes hot due to an active heat source, the heating segment expands as a result of the thermal effect. At the operating temperature the heating segment reaches preferably its desired size and/or a size that is slightly above the desired size. The effect of this measure is that the compensating element causes the mold surface of the heating segment to move in an exactly manner into the absolute position in relation to the mold cavity. Then any fluctuations, as a result of the varying temperatures during the production process, will be compensated for by the slight oversize and/or the compensating element.

The compensating element is designed preferably as a mechanically passive element with one degree of freedom of linear motion, in particular, in the press stroke direction. Furthermore, the compensating element is a resilient element, in particular, a spring, even more highly preferred, a helical compression spring. Furthermore, it is particularly preferred that a plurality of compensating elements, in particular, a plurality of springs, be distributed in such a way that the heating segment is prevented from tilting on compression of the compensating element. Then the number and position and/or spring rate of the compensating elements, in particular, the springs, may be designed as a function of the degree of forming and/or the surface pressure, acting on the respective section of the face of the heating segment. For example, if a section of the heating segment is thin, then just one compensating element alone is sufficient, whereas in the case of a wide section three, four or five compensating elements are positioned in such a way that they are spaced apart from each other. However, the compensating element may also be a cushion, in particular, a hydraulic cushion that is filled with a compressible fluid.

Furthermore, it is particularly preferred that the top tool be mounted on a ram table; and/or that the bottom tool be mounted on a press table. The rear side of the segments is position-fixed preferably in a positive locking manner on the ram table in the case of the top tool; and in the case of the bottom tool, on the press table preferably by incorporation of a clamping plate. Then the respective heating segment is floatingly mounted; and it is particularly preferred that it comprise a linear guide. The linear guide is designed, in particular, in such a way that the degree of freedom of linear motion is in the direction of the press stroke. In particular, the guide is designed as a guide rod, which engages with a guide hole, thus, as a sliding guide with a positive fit.

It is particularly preferred that the linear guide be arranged centrally on the heating segment relative to a plane perpendicular to the press stroke direction of the hot forming tool. Thus, the substantially central centering allows the heating segment to expand longitudinally in all directions of the plane. The expansion in the press stroke direction itself is achieved once again by means of the compensating element.

Furthermore, it is particularly preferred that an insulating layer be disposed on the rear side of the heating segment; and/or that insulating layers be disposed on the side edges or more specifically the side faces of the heating segment. Owing to the insulating layer it is possible to minimize the loss of heat both in the case of an active heating segment, since the flow of heat is supposed to be concentrated only on the sheet metal blank, but the thermal conduction in the heating segment itself occurs in all directions, thus, also towards the rear side of the heating segment. The use of an insulating layer can reduce the input of energy to actively heat the heating segment. The insulating layer on the side edges or rather the side faces of the heating segment is designed in such a way that the conduction of heat to the segment adjacent to the heating segment is suppressed. In this case, too, the input of energy to warm up and heat the heating segment is minimized, and at the same time a sharply defined transition region is achieved on the component to be produced.

In another preferred design variant the heating segment is made of a material that exhibits less thermal conductivity than the rest of the top tool and/or bottom tool. Thus, the thermal conductivity of the material of the heating segment is less than the thermal conductivity of the materials of the segments adjacent to the heating segment.

It is particularly preferred that the material of the heating segment exhibit higher thermostability. In the case of the segments adjacent to the heating segment the goal is to achieve a high dissipation of heat, so that the press-hardening process is carried out. However, in the case of the heating segment itself the key criterion is that no heat or only significantly smaller amounts of heat are dissipated, so that no hardening or in any case a partial hardening takes place. Due to the fact that the heating segment has to dissipate only a small amount of heat, said heating segment exhibits higher thermal stability. The term thermal stability is defined as the dimensional stability during temperature control of the heating segment.

In addition, another preferred embodiment provides as an option that the cooling channels in the heating segment be designed in such a way that the region of the formed sheet metal component that is produced also abuts the heating segment and can be at least partially cooled. This arrangement makes it possible, for example, to achieve by choice a partially hardened mixed microstructure. In addition, this arrangement makes it possible to fulfill the objective of rapidly reaching a state in the heating segment that is lukewarm during maintenance or of not overheating the heating segment during maintenance.

Furthermore, it is particularly preferred to design a gap, in particular, an air gap between the heating segment and at least one of the adjacent segments of the heating segment. This air gap has two advantages. First, the effect of the gap, thus, the physical separation, is that no heat is conducted from the heating segment to an adjacent segment. Hence, the transition region may be defined with more sharpness.

However, the second advantage is that said air gap makes it possible for the heating segment to expand in the horizontal direction. Owing to the compensating element the heating segment can expand in the press stroke direction, where in this case the press stroke direction is usually vertically oriented.

The gap allows the heating segment to expand horizontally, thus, transversely to the press stroke direction, whereas due to the linear guide it is preferably mounted in the center so as to be secure against displacement in the horizontal direction.

Furthermore, the present invention relates to a method for producing a press-hardened steel component that is to be formed, in particular, a motor vehicle component, with strength properties that are partially different from each other. The method is characterized by the following process steps:

- heating a blank made of a hardenable steel alloy in a heating station, where in this case at least a first region is heated to above austenitizing temperature (AC3); and at least a second region is heated to below austenitizing temperature, preferably to less than AC1; and between these two regions a transition region is formed;
- transferring the resulting heated blank into a temperature control station or a hot forming and press-hardening tool, where in this case the temperature control station or the hot forming and press-hardening tool is designed so as to be
- segmented and has at least one temperature control segment, where in this case the temperature control segment is disposed in the region of the resulting transition region of the heated blank;
- temperature controlling the transition region with the temperature control segment to a temperature below the AC1 temperature, preferably, however, to a temperature higher than 450 deg. C., in particular, higher than 550 deg. C.;
- hot forming and press hardening the steel component comprising at least one hard region and one soft region as well as an in-between transition zone.

The inventive method makes it possible to produce a particularly sharply defined narrow transition zone between the completely hardened region of the steel component that is produced and the opposite softer region of the steel component. The completely hardened region consists preferably almost completely of a martensitic microstructure, which was rapidly quenched accordingly by a temperature exceeding AC3. The opposite softer region has preferably a mixed microstructure comprising the individual additional and/or respective microstructural constituents: bainite, ferrite, perlite and/or residual austenite. This is produced, in particular, due to the fact that either the more ductile and, thus, softer region of the steel component is not completely austenitized before hot forming and/or is not rapidly quenched during the press hardening process so that a complete martensitic microstructure is avoided; preferably no martensitic microstructure is formed.

In the course of heating the blank the transition region is initially designed to be very wide, for example, with a width exceeding 100 mm and preferably between 100 and 200 mm. This feature is necessary because, on the one hand, the heating station, for example, configured as a continuous furnace or a multiple hearth furnace, is provided with a partition that has a width, for example, of several centimeters for thermal insulation purposes between two temperature zones, for example 900 deg. C. and 600 deg. C., so that the blank has a transition region of more than 100 mm merely because of the different temperature effects in both temperature zones of the heating station. An additional factor is the thermal conduction inside the blank itself. The blank is made of a hardenable steel alloy that also has high thermal conductivity. If, for example, a region of the blank heats up to more than 900 deg. C., and another region heats up to less than 700 deg. C., then the heat will be conducted from the hotter region to the cooler region inside the blank. This arrangement will also generate a transition region that has a corresponding width of more than 100 mm. The periods of heat in the heating station range preferably from 1 to 20 minutes and, in particular, from 3 to 7 minutes.

The inventive method begins precisely at this point that a hot forming and press-hardening tool or, as an alternative, a temperature control station are used that comprise a temperature control segment. The temperature control segment itself is designed so as to cover only a small region in relation to the whole surface area of the blank or more specifically the component to be formed, so that in essence the temperature control segment covers approximately only the transition region of the heated blank. The temperature control segment is brought into contact with the transition region and then can either reheat or cool owing to the fact that the transition region is temperature controlled by contact; or in the case of a press-hardening tool the temperature control segment can be kept warm during quench hardening, so that the result is a lower rate of cooling. In the case of a temperature control station the blank that is to be heat treated from the heating station is first moved into the temperature control station. In the temperature control station at least the transition region is temperature controlled by controlling the temperature through contact, so that the effect is a sharply defined, now narrow transition region that forms a sharply defined transition zone after press hardening. Finally the blank is placed directly into a hot forming and press hardening tool, thus, preventing any additional heat from being conducted into the blank and, as a result, an enlargement of the transition region. Then the hot forming tool can be homogeneously cooled in a very advantageous way without the heating segments.

In the event that the temperature control segment is removed from the heating station and brought directly into the hot forming and press-hardening tool, the temperature control segment is disposed in the hot forming and press-hardening tool itself, where the temperature control segment is designed, in particular, as a heating segment and is temperature controlled. In particular, it heats the transition region of the blank during press hardening.

The transition region is temperature controlled in such a way that on the finished component this transition region belongs to the softer or rather more ductile region. This means in turn that the transition region of the blank that is produced in the heating station is cooled from initially approximately 700 deg. C. to 800 deg. C. to below the AC1 temperature, in particular, cooled to 500 deg. C. to 650 deg. C. and/or is heated during the press hardening process in such a way that the result is a lower cooling rate and, thus, virtually no martensite formation is produced in the transition region.

Thus, within the scope of the invention it is possible to produce a sharply defined transition region that has a width between 50 mm and 200 mm in the blank, which is temperature controlled in the heating station, in a process optimized manner and in a simple way in terms of energy as a transition zone having a width between 1 mm and 50 mm, in particular, between 15 mm and 40 mm, even more preferred between 20 mm and 30 mm on the component produced according to the press hardening process.

For this purpose the temperature control segment is disposed in the top tool and/or bottom tool of the temperature control station or the hot forming and press-hardening tool. The temperature control segment has such dimensions that it covers an area percentage of 50 to 95% of the transition region of the heated blank.

In an additional advantageous design variant the temperature control segment is dimensioned in such a way that it additionally overlaps, starting from the transition region, the region, which is heated to below AC3, in particular below AC1 temperature; furthermore, up to 70 mm, in particular, up to 60 mm and even more preferred up to 50 mm. In total, then the temperature control segment covers a surface area that corresponds to 70 to 140% of the transition region.

The method is carried out, in particular, on a hot forming tool described in the introductory part. Furthermore, it is especially preferred that a compensating element be disposed behind the temperature control segment, so that the different rates of thermal expansion of the temperature control segment are compensated for or rather equalized, in particular, in the press stroke direction of the hot forming tool.

BRIEF DESCRIPTION OF THE DRAWINGS

Other advantages, features, properties and aspects of the present invention are the subject matter of the following description. Preferred design variants are shown in the schematic figures. They are used only to make the invention easier to understand. The drawings show in.

The same reference numerals are used to denote identical or similar components in the figures, even if a description is not repeated for the sake of simplification.

DETAILED DESCRIPTION OF THE PREFERRED EMBODIMENTS

Further scope of the applicability of the present invention will become apparent from the detailed description given herein after. However, it should be understood that the detailed description and specific examples, while indicating preferred embodiments of the invention, are given by way of illustration only, since various changes and modification within the spirit and scope of the invention will become apparent to those skilled in the art from this detailed description.

Figure 1B:
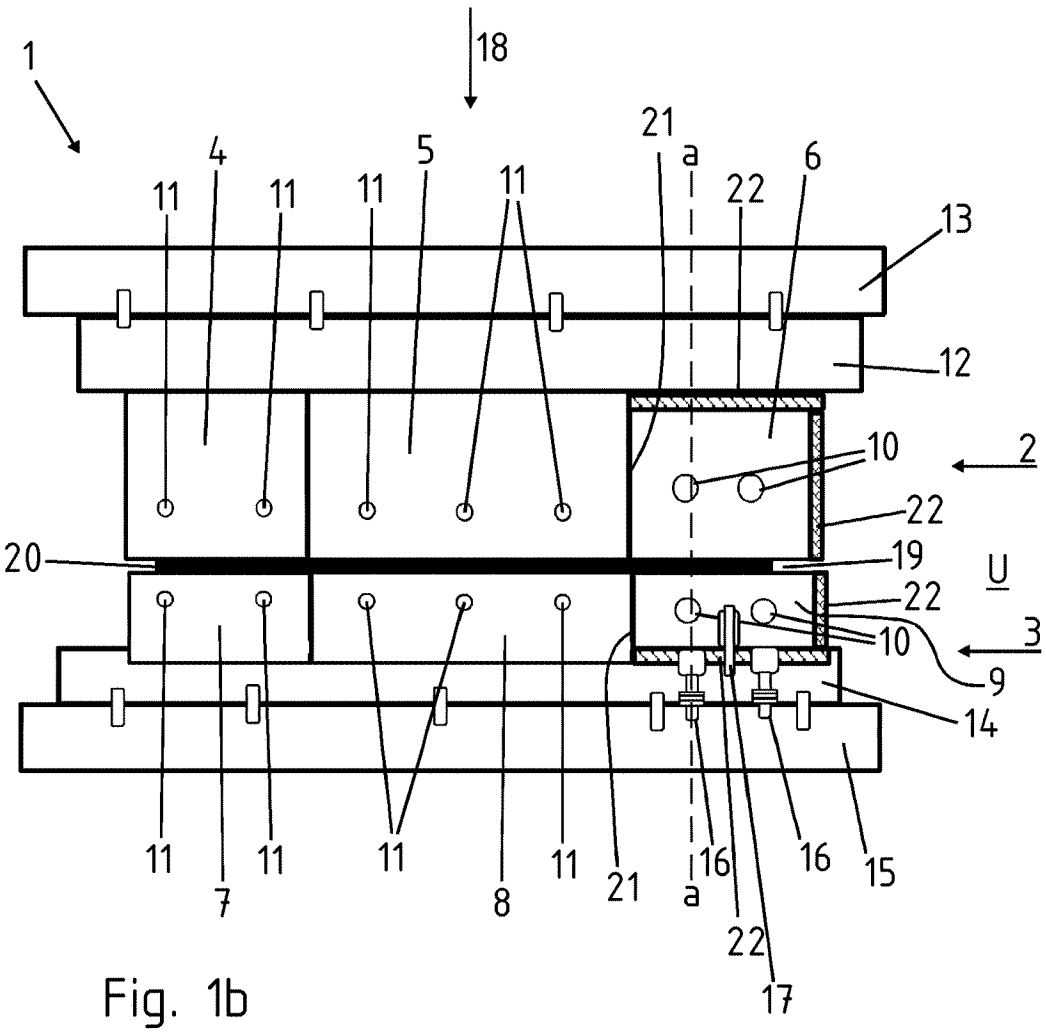
FIGS. 1*a* and *b* an inventive hot forming tool in a cross sectional view and side view.
Figure 1A:
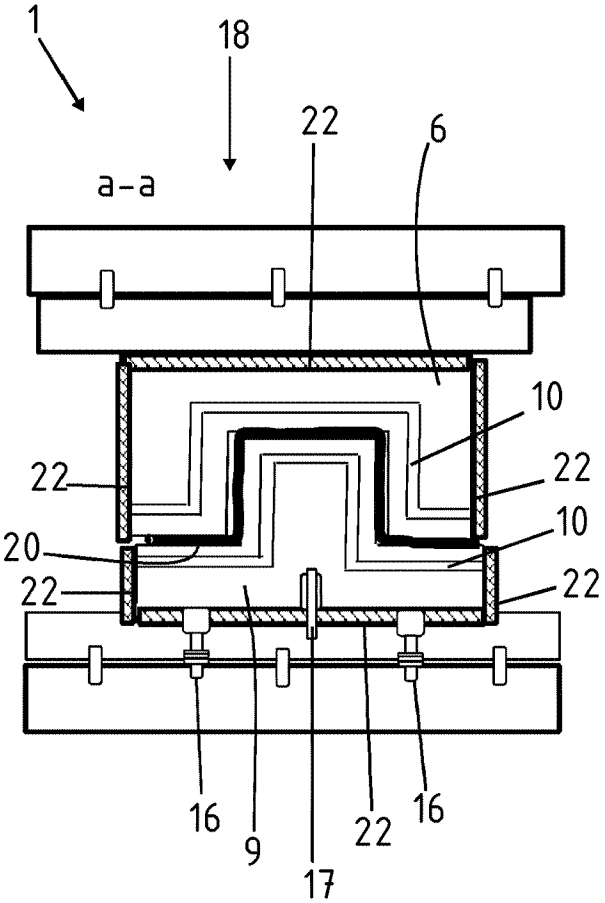

FIG. 1 shows an inventive hot forming tool 1; in the case of FIG. 1*b*, in a side view; and in the case of FIG. 1*a*, in a cross sectional view along the section line a-a. The hot forming tool 1 has a top tool 2 and a bottom tool 3, where in this case the top tool is made of three segments 4, 5, 6, which comprise two normal segments 4, 5 and a heating segment 6; and the bottom tool 3 is also made of three segments 7, 8, 9. In this case, too, they also comprise two segments 7, 8 and a heating segment 9.

The heating segments 6, 9 have in each instance two heat sources 10, for example, media lines for conveying a heating medium or also heating coils or the like. The remaining segments 4, 5, 7, 8 have in each instance cooling channels 11.

At the same time the segments 4, 5 of the top tool 2 are attached to a ram table 13 by incorporation of a clamping bed 12. The segments 7, 8 of the bottom tool 3 are attached to a clamping bed 14, which in turn is mounted on a press table 15. The attachment is done, for example, with T-slot nuts.

At this point the invention provides that the heating segment 9 of the bottom tool 3 is floatingly mounted by way of compensating elements 16, where in this case the compensating elements 16 are designed at least partially as springs. In addition, it can be seen very clearly in FIGS. 1*a* and 1*b* that the linear guide 17 is centrally disposed and exhibits one degree of freedom of axial motion in the press stroke direction 18. Transversely to the press stroke direction 18, the linear guide 17 is disposed centrally on the heating segment 9, so that the heating segment 9 can expand or contract in all directions transversely to the linear guide 17 owing to the thermal effect.

The hot forming tool 1 is shown in the closed state, so that a mold cavity 19 is produced between the top tool 2 and the bottom tool 3. When the hot forming tool 1 is closed, a formed sheet metal component 20 is in abutting contact with the respective surface of the segments 4, 5 in the mold cavity 19. The compensating elements 16 compensate for any possible varying expansion in the press stroke direction 18 of the heating segment 9 relative to the segment 8 adjacent thereto.

In addition, a gap 21 is provided between the heating segment 9 and the segment 8 as well as between the heating segment 6 and the segment 5, and said gap prevents the heat from being conducted from the heating segment 6, 9 to the segment 5, 8.

In this case the heating segment 6 is not resiliently mounted on the top tool 2. Insulating layers 22 are disposed on the side of the heating segments 6, 9 that faces away from the mold cavity 19, so that the heat is largely prevented from being conveyed to the respective clamping beds 12, 14 due to thermal conductivity. Furthermore, insulating layers 22 are also disposed on the external side faces of the heating segments 6, 9, so that the heat is also prevented from being dissipated to the surrounding environment U.

Figure 2B:
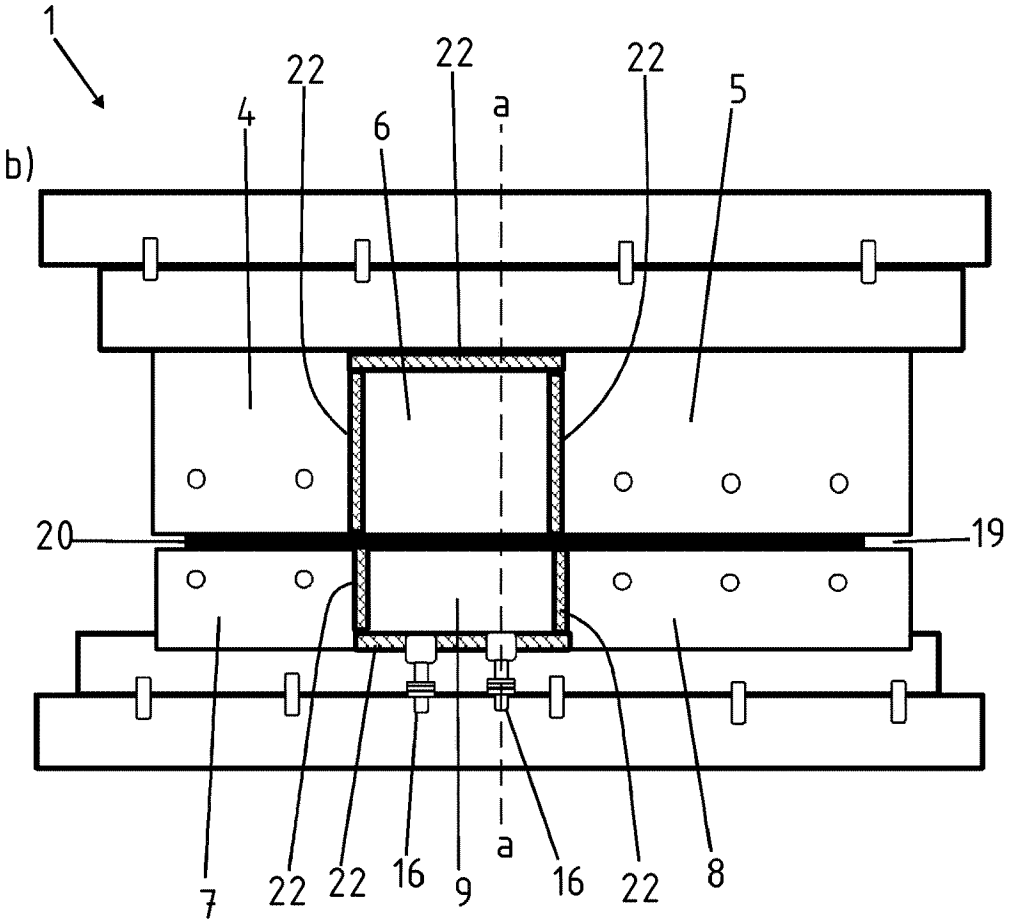
FIGS. 2*a* and *b* an alternative design variant to FIGS. 1*a* and *b* with heating segment located internally.
Figure 2A:
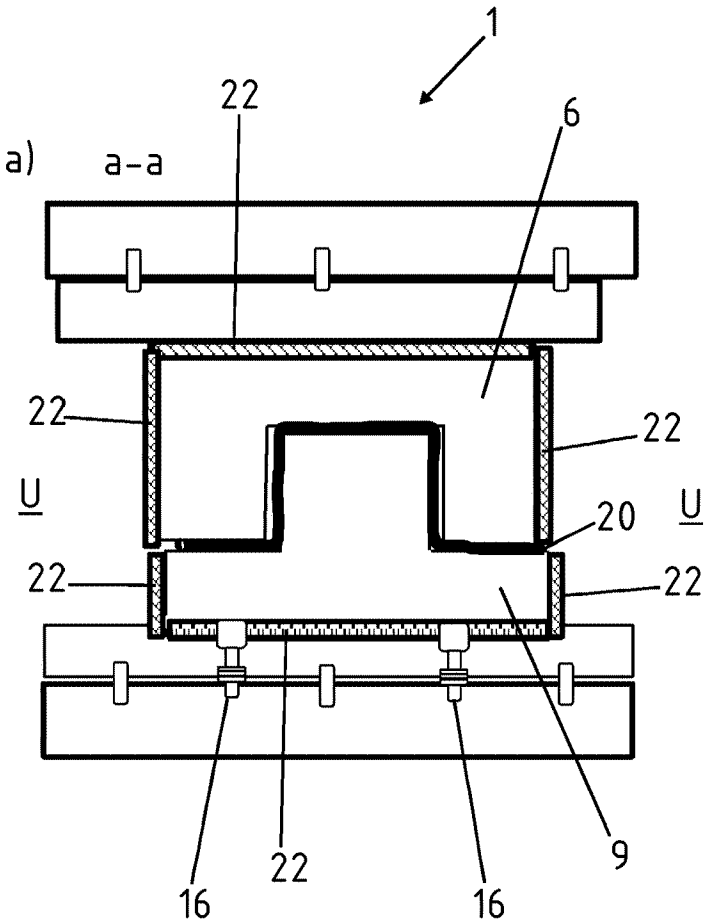

FIGS. 2*a* and *b* show an analogous design variant to FIG. 1 with the differences described below. Based on the drawing in FIG. 2*b*, the heating segments 6, 9 are disposed internally. In this case, too, the heating segment 6, 9 of the bottom tool 3 is also mounted in a floating or more specifically resilient manner by means of compensating elements 16, so that varying thermal expansion in the press stroke direction 18 is suppressed. In addition, a corresponding insulating layer 22 is disposed between the respective heating segment 6, 9 and, adjacent thereto, the segment 4, 5, 7, 8. Furthermore, it can be seen in FIG. 2*a* that there is no guide, but rather the compensating elements also assume a guide function; and insulating layers 22 are also disposed relative to the surrounding environment U.

Figure 3:
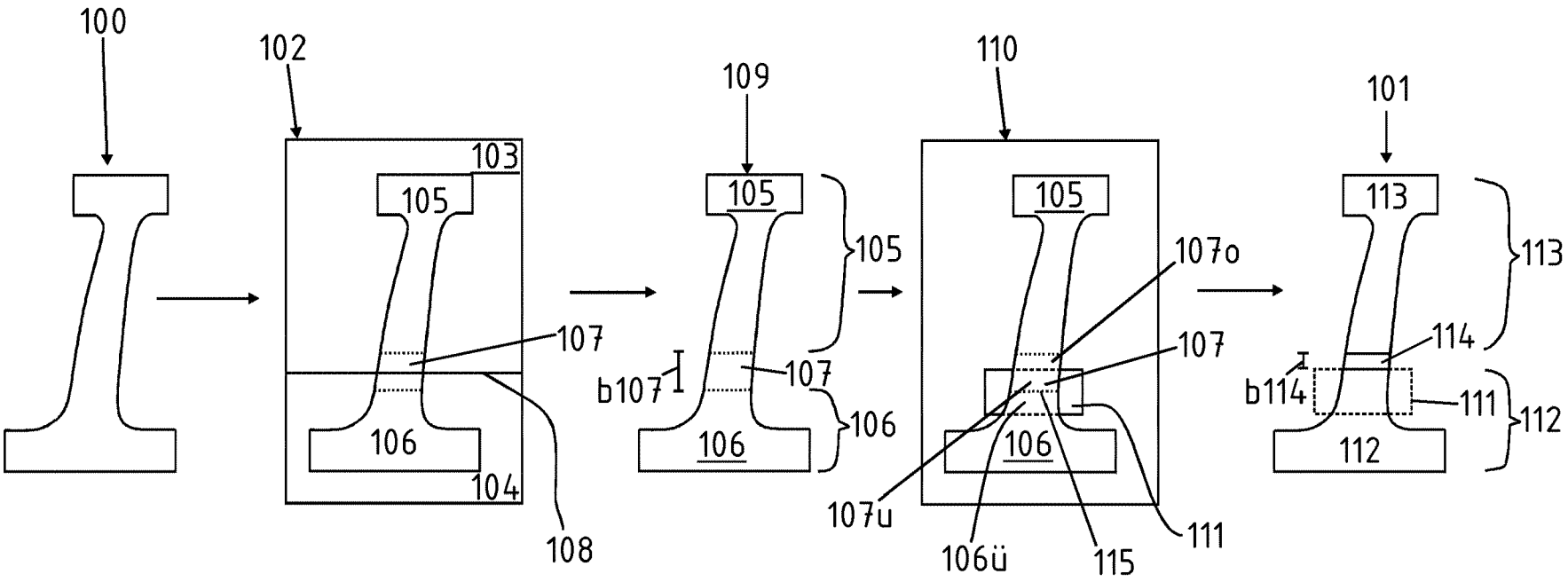
FIG. 3 the inventive method for producing a hot formed and press-hardened steel component with different strength regions.

FIG. 3 shows the process flow of the method described according to the invention. First, a blank 100 made of a hardenable steel alloy is provided. In this case said blank already has a precut blank for producing a steel component 101 in the form of a B-pillar for a motor vehicle. The blank 100 is brought into a heating station 102, here, for example, configured as a continuous furnace. The heating station 102 has two different temperature zones 103, 104: in relation to the image plane an upper temperature zone 103 above the AC3 temperature and in relation to the image plane the lower temperature zone 104 with a temperature below AC1. As a result, a first region 105 of the blank 100 is heated to the AC3 temperature or higher; and a second region 106 is heated to a temperature below AC1. Between the first region 105 and the second region 106 there is a wide transition region 107 that is produced, on the one hand, owing to the thermal conduction inside the blank 100 itself, and on the other hand, due to the fact that a partition 108 of the heating station 102 has a certain width, in order to provide a thermal insulation between the temperature zone 103 above AC3 and the temperature zone 104 below AC1.

After removal from the heating station 102 a temperature controlled blank 109 is made available, in which a first region 105 of said blank is formed above the austenitizing temperature; and a second region 106 is formed below the AC1 temperature. Between said first and second region there is a transition region 107 having a width b107 of 50 mm to 200 mm.

The resulting temperature controlled blank 109 is placed in a hot forming and press-hardening tool 110, which is shown here by way of example by means of the top view of a bottom tool and in which at least one segment is disposed. This segment is designed as a temperature control segment 111 and, in particular, a heating segment. The temperature control segment 111 covers in terms of surface area a large part of the transition region 107 and also overlaps, starting from the transition region 107, a portion of the second region 106, which may be at a temperature below AC1. The temperature control segment 111 makes it possible to control the cooling rate during the press-hardening process and, in particular, to achieve a lower cooling rate, so that in the transition region 107 a martensite formation is largely avoided. Consequently the second region 106 has a soft region 112 compared to a hard region 113. In this case the soft region 112 also extends over a large part of the initially present transition region 107; and a sharply defined transition zone 114 having a width b114 of preferably 10 mm to 35 mm, in particular, between 20 mm and 30 mm is produced. The dashed line shows in the finished steel component 101 the theoretical position of the temperature control segment 111.

In this case the width b114 of the transition zone 114 corresponds to preferably less than half the width b107 of the transition region 107, in particular less than one-third of the width b107 and preferably less than one-fourth of the width b107. Furthermore, it is shown in the hot forming and press-hardening tool 110 that the temperature control segment 111 does not cover an upper portion 107*o* of the transition region 107, but does cover a lower portion 107*u* of the transition region 107; and in this case the lower portion 107*u* of the transition region 107 corresponds to preferably 50 to 95% of the area of the transition region 107. Furthermore, the temperature control segment 111 extends then, starting from the transition region 107, in the direction of the second region 106 with a width of preferably 70 mm, in particular, 60 mm and even more preferred 50 mm. This covered second region 106*ii* is described with the reference numeral 106*ii*. This feature ensures that even the interface 115 between the second region 106 and the transition region 107 obtains a homogeneous material microstructure during the press hardening process.

Thus, in the hot forming and press-hardening tool 110 it is possible to achieve by simple and effective measures with a conventional heating station 102 and a modified hot forming and press-hardening tool 110 a sharply defined, highly precise transition zone 114 between different strength regions 112, 113 on a steel component 101.

Furthermore, preferably A-pillars, roof assemblies, rear door windows, or similar motor vehicle components that exhibit, in particular, soft regions over a large area are produced.

The invention being thus described, it will be apparent that the same may be varied in many ways. Such variations are not to be regarded as a departure from the spirit and scope of the invention, and all such modifications as would be recognized by one skilled in the art intended to be included within the scope of the following claims

LIST OF REFERENCE NUMERALS

1—hot forming tool
2—top tool
3—bottom tool
4—segment to 2
5—segment to 2
6—heating segment to 2
7—segment to 3
8—segment to 3
9—heating segment to 3
10'heat source
11—cooling channel
12—clamping bed to 2
13—ram table
14—clamping bed to 3
15—press table
16—compensating element
17—guide
18—press stroke direction
19—mold cavity
20—blank
21—gap
22—insulating layer
23—rear side to 6, 9
100—blank
101—steel component
102—heating station
103—temperature zone above AC3
104—temperature zone below AC1
105—first region to 100
106—second region to 100
106*ii*—covered second region
107—transition region to 100
107*o*—upper portion to 107
107*u*—lower portion to 107
108—partition

109—temperature controlled blank
110—hot forming and press-hardening tool
111—temperature control segment
112—soft region
113—hard region
114—transition zone to 101
115—interface
b107—width to 107
b114—width to 114
U—surrounding environment

What is claimed is:

1. A hot forming tool for forming a component, said hot forming tool comprising:

a top tool and a bottom tool, both of which are movable towards each other, and having, when the hot forming tool is in a closed position, a mold cavity formed between the top tool and the bottom tool, with at least one of the top tool and the bottom tool being divided into at least two segments, with one segment of the at least two segments being configured as a heating segment, and with, when the hot forming tool is in the closed position, the top tool and bottom tool segments being in contact with a surface of the component being formed, the heating segment including a compensating element on a side thereof opposite the mold cavity to compensate for a thermal expansion of the heating segment in a press stroke direction, and the heating segment being mounted with at least one linear guide that includes a guide rod configured to slidably engage, with a positive fit, a guide hole, and the linear guide having one degree of axial freedom in the press stroke direction and being disposed centrally on the heating segment, transversely to the press stroke direction relative to a plane, such that the heating segment is capable of thermally expanding in all directions of the plane, starting from the linear guide.

2. The hot forming tool according to claim 1, wherein the heating segment is actively heated.

3. The hot forming tool according to claim 2, wherein the heating segment is actively heated by a heat source which is integrated therein.

4. The hot forming tool according to claim 1, wherein the heating segment is configured to be undersized at room temperature.

5. The hot forming tool according to claim 1, wherein the compensating element is a mechanical passive element with one degree of freedom of linear motion, and wherein the heating segment is mounted so as to float.

6. The hot forming tool according to claim 5, wherein the mechanical passive element is a spring.

7. The hot forming tool according to claim 1, wherein the compensating element is a cushion.

8. The hot forming tool according to claim 7, wherein the compensating element is a hydraulic cushion.

9. The hot forming tool according to claim 1, wherein the top tool is mounted on a ram table, and/or the bottom tool is mounted on a press table.

10. The hot forming tool according to claim 1, wherein at least one of (i) an insulating layer is disposed on the side of the heating segment opposite the mold cavity and (ii) insulating layers are disposed on external side faces of the heating segment.

11. The hot forming tool according to claim 1, wherein the heating segment has a material of construction that exhibits less thermal conductivity than adjacent segments of the top tool and/or bottom tool.

12. The hot forming tool according to claim 11, wherein the material of the heating segment exhibits higher thermostability.

13. The hot forming tool according to claim 1, further comprising cooling channels for conveying a cooling medium, the cooling channels being disposed in segments of the top tool and/or bottom tool.

14. The hot forming tool according to claim 1, further comprising cooling channels that are formed in the heating segment.

15. The hot forming tool according to claim 1, wherein a gap is formed between the heating segment and an adjacent segment.

16. The hot forming tool according to claim 15, wherein the gap is an air gap.

17. The hot forming tool according to claim 1, wherein the hot forming tool is configured to form a blank from a steel alloy or a light metal alloy.

18. The hot forming tool according to claim 1, wherein the hot forming tool is configured as a hot and press-hardening tool.

* * * * *